US005611305A

United States Patent [19]

Faye

[11] Patent Number: 5,611,305

[45] Date of Patent: Mar. 18, 1997

[54] METHOD AND APPARATUS FOR STARTING AN INTERNAL COMBUSTION ENGINE

[76] Inventor: Robert L. Faye, 12342 Winfree St., Chester, Va. 23831

[21] Appl. No.: 625,868

[22] Filed: Apr. 1, 1996

[51] Int. Cl.[6] ..... F02N 9/02

[52] U.S. Cl. ..... 123/179.5; 123/179.11; 123/184.1

[58] Field of Search ..... 123/179.5, 179.11, 123/184.1, 641, 642

[56] References Cited

U.S. PATENT DOCUMENTS

| | | | |
|---|---|---|---|
| 972,512 | 10/1910 | Daimler et al. | 123/179.11 |
| 1,049,122 | 12/1912 | Meeder | 123/179.11 |
| 4,917,060 | 4/1990 | Harada et al. | 123/642 |
| 5,074,263 | 12/1991 | Emerson | 123/179.5 |

*Primary Examiner*—Andrew M. Dolinar
*Attorney, Agent, or Firm*—Norman B. Rainer

[57] ABSTRACT

A method and apparatus for starting a multi-cylinder internal combustion engine having an electrical ignition system employs a manually operable device such as a piezo crystal for generating an electrical pulse which is routed to the center terminal of a standard automotive distributor. A first diode is disposed in the conductor wire that conveys the pulse to the distributor. A second diode is disposed in a feed wire that conducts current to the center terminal from the electrical ignition system. Both diodes are similarly directed so as to isolate the generated pulse at the distributor. A manually operated pumping mechanism is caused to deliver liquid fuel to the cylinders of the engine simultaneously with the generation and routing of the electrical pulse.

8 Claims, 1 Drawing Sheet

METHOD AND APPARATUS FOR STARTING AN INTERNAL COMBUSTION ENGINE

BACKGROUND OF THE INVENTION

1. Field of the Invention

This invention concerns internal combustion engines, and more particularly relates to the starting of such engines without a conventionally employed storage battery or other energy source.

2. Description of the Prior Art

Internal combustion engines operate on the principle that a liquid fuel, when ignited and combusted in a cylinder equipped with a reciprocating piston, generates a large volume of gas which pushes the piston toward the opposite extremity of the cylinder. In order to start the engine, fuel must be within the cylinder while the piston is at its outer-most point of travel within the cylinder, often referred to as Top Dead Center of the "power stroke", and means must be provided for igniting or "firing" the fuel. In engines having a multiplicity of cylinders whose pistons cooperatively engage a crankshaft, the sequence of firing of the cylinders is important in the starting and continued operation of the engine.

Before the advent of storage batteries, internal combustion engines such as those on automotive vehicles were started by hand-cranking. The crank was geared so as to rotate the crankshaft. When manually rotated, the crankshaft performs the several sequential steps involved in the normal running of the engine, namely: feeding fuel to the cylinders, producing properly staged movement of the pistons, and supplying a magneto-generated spark to appropriate cylinders by way of a "distributor" switching device. However, the manual cranking of an engine is difficult even with relatively small engines, and almost impossible with high horsepower engines employed in modern vehicles.

Internal combustion engines, as on automotive vehicles, can be extremely difficult to start in cold weather or after long standing, even when the engine is equipped with a heavy duty storage battery and starter motor adapted to rotate the crankshaft.

Various expedients have been proposed for starting internal combustion devices. For example, explosive devices have been disclosed in U.S. Pat. No. 1,877,936 and elsewhere. Modifications involving the delivery to the cylinders of a highly volatile starting fuel such as dimethyl ether is disclosed in U.S. Pat. Nos. 2,053,321; 3,494,340; 3,661,133; 5,119,775 and 5,195,477.

U.S. Pat. No. 2,348,621 concerns an engine starting system equipped with means driven independently of the normal engine timing for effecting intake and exhaust in the engine cylinders and for timing the ignition means. The equipment required is of complex construction, and cannot be feasibly retrofitted onto engines of ordinary design. Also, a storage battery and accompanying starter motor are still necessary components of this system.

It is accordingly an object of the present invention to provide a method for starting an internal combustion engine.

It is a further object of this invention to provide a method as in the foregoing object which does not require use of a storage battery, starter motor or other energy source such as a flywheel or external means of cranking the engine.

It is another object of the present invention to provide manually operable apparatus for accomplishing the aforesaid method for starting an internal combustion engine.

It is a still further object of this invention to provide apparatus of the aforesaid nature which is easily installable upon and compatible with internal combustion engines of conventional design.

These objects and other objects and advantages of the invention will be apparent from the following description.

SUMMARY OF THE INVENTION

The above and other beneficial objects and advantages are accomplished in accordance with the present invention by a method for starting an internal combustion engine having a multiplicity of cylinders equipped with a reciprocating piston and igniter adapted to fire when said piston is in its power stroke position, fuel supply means, a crankshaft driven by the synchronized successive movements of said pistons, a timing system interactive with said crankshaft, an electrical system, and a distributor having a center input terminal that receives a continuous current through a feed wire from said electrical system, said distributor serving to produce an electrical output pulse and route said pulse to the igniter means of the single cylinder designated by said timing system to be momentarily in its power stroke position, said method comprising:

a) injecting liquid fuel into all cylinders, b) producing an electrical input pulse by manually generated means, and c) routing said input pulse to the single cylinder in the power stroke position, said routing being achieved by causing said input pulse to enter the center terminal of said distributor through an intervening first diode.

The apparatus of the present invention is comprised of:

a) manually activatable means for generating an electrical input pulse, b) a manually activatable pump for liquid fuel, c) conveying means for transferring liquid fuel from said pump to the cylinders of said engine, d) an electrical conductor configured to carry said pulse to the distributor of the engine, e) an intervening first diode associated with said electrical conductor and a second diode associated with said feed wire, said diodes having the same polarity with respect to said distributor and adapted to isolate said input pulse from the engine's electrical system.

BRIEF DESCRIPTION OF THE DRAWING

For a fuller understanding of the nature and objects of the invention, reference should be made to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
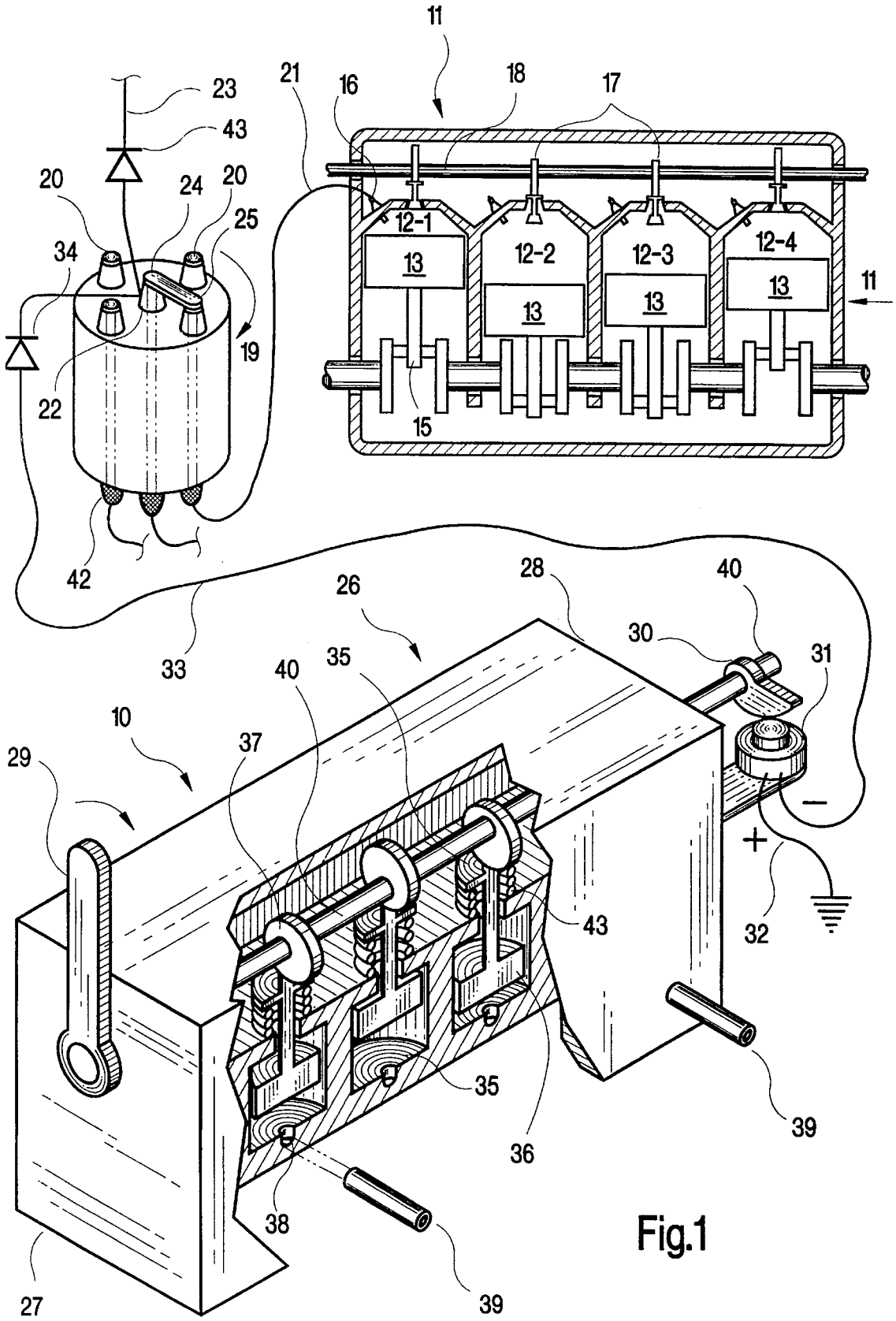
FIG. 1 is a schematic view of an embodiment of the apparatus of the present invention shown in operative association with a conventional internal combustion engine, shown in reduced size.

Referring to FIG. 1, an embodiment of the apparatus 10 of the present invention is shown in operative association with a four cycle gasoline-based internal combustion engine 11. Said engine is comprised of four cylinders designated as 12-1, 12-2, 12-3 and 12-4, and arranged in an in-line configuration. A piston 13 is reciprocatively associated with each cylinder. Each piston is pivotably joined to crankshaft 14 by way of arm 15. Igniter means in the form of sparkplug 16, and valve means 17, are disposed within the upper extremity of each cylinder. A camshaft 18 controls the movement of said valve means 17, said camshaft being synchronously driven by said crankshaft.

A distributor device 19 of conventional construction has contact terminals 20 which communicate by way of electrical output conductor wires 21 with each spark plug. A central input terminal post 22 receives a continuous electrical current from said electrical system through feed wire 23. A rotor blade 24 rotates about central post 22 in electrical communication with conductor wire 23. The distal extremity 25 of blade 24 achieves sequential electrical contact with input terminals 20, thereby routing electrical impulses to the appropriate output terminals 42 and thence to the corresponding sparkplugs to achieve proper firing sequence of the cylinders. The rotation of blade 24 is synchronized with respect to the rotation of the crankshaft.

Other conventional components of engine 11, not shown in FIG. 1, include a carburetor which produces a combustible fuel/air mixture, an inlet manifold which supplies said combustible mixture to the intake valves, an exhaust manifold which receives spent gases from the exhaust valves, an ignition coil which transforms the usual 12 volt D.C. battery current to a much higher voltage to operate the sparkplugs, and a timing belt or equivalent means that synchronously interconnects the camshaft with the crankshaft.

The illustrated embodiment of the apparatus of this invention employs a control box 26 elongated between first and second panel end extremities 27 and 28, respectively. An activating rod 40 passes through box 26 in journaled engagement with both panel extremities 27 and 28. An operating lever 29 is attached to rod 40 outside said box and in close adjacency to first panel extremity 27. A striking cam 30 is attached to rod 40 outside said box and in close adjacency to second panel extremity 28. A piezo crystal device 31 is positioned so as to receive a striking blow from cam 30. The positive output extremity of the piezo device is grounded by way of conductor wire 32 to the chassis of the engine or vehicle. The negative output extremity of the piezo device is connected by way of conductor wire 33 to first isolation diode 34. From said diode, conductor wire 33 continues to joinder with input terminal post 22 of said distributor. A second isolation diode 43 is disposed within feed wire 23 in the same polarity direction with respect to distributor 19 as said first diode. The two diodes function interactively to prevent the input pulse transmitted through wire 33 from entering that portion of the vehicle's electrical system which precedes the distributor.

The piezo device is based upon the phenomenon that certain crystals, such as quartz and Seignette salt, produce an electric pulse when subjected to mechanical pressure. Electrical leads, attached to opposite faces of the crystal, conduct current away from the crystal.

Other manually operable devices may be utilized to produce a useful electrical pulse. One such device is a magneto of the type generally employed to detonate explosives. The magneto is in effect a miniature electrical generator, involving a stator and rotor wherein rotation causes a coil of wire to pass through a magnetic field.

Control box 26 further houses pumping means in the form of cylinders 35 and interactive pistons 36 which are driven downwardly by cams 37 on rod 40 and restored to their uppermost position by coil springs 43. An exit port 38 is associated with the bottom of each cylinder 35. Gasoline or other liquid fuel emergent from ports 38 is conveyed by tubing 39 to the cylinders of the engine. The fuel may be caused to enter the engine cylinder by way of either a modified sparkplug or modified cylinder head. The pressure exerted upon the liquid fuel in control box 26 is of sufficient magnitude to produce atomization of the fuel as it enters the cylinders 12 of the engine. Such feature assures ignition of the liquid fuel within the cylinders of the engine.

In the engine-starting method of this invention, gasoline or other volatile liquid fuel is entered into control box 26. Lever 29 is then moved rapidly and forcefully downward. Such action pumps the fuel to all cylinders of the engine, and at the same time produces an electrical impulse that travels to the distributor. The distributor is synchronized to route the electrical impulse to that cylinder which is in its power stroke. Accordingly, an electrical impulse is transmitted from the piezo crystal to the appropriate cylinder with respect to the proper firing sequence, said cylinder having fuel by virtue of the pumping means in the control box. Such concerted actions cause the engine to start by igniting the fuel in that cylinder which is in its power stroke. Such action forces the corresponding piston downwardly, causing the crankshaft to rotate sufficiently to move the next cylinder in the firing order past top dead center (T.D.C.) At this point, the engine's own ignition system will provide the needed spark to ignite the fuel supplied by control box 26 and thereby propagate the firing sequence. Each piston 13 in turn forces the next piston over T.D.C. until the engine starts.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A method for starting an internal combustion engine having a multiplicity of cylinders equipped with a reciprocating piston and igniter adapted to fire when said piston is in its power stroke position, fuel supply means, a crankshaft driven by synchronized successive movements of said pistons, a timing system interactive with said crankshaft, an electrical system, and a distributor having a center input terminal that receives a continuous current through a feed wire from said electrical system, said distributor serving to produce an electrical output pulse and route said pulse to the igniter means of the single cylinder designated by said timing system to be momentarily in its power stroke position, said method comprising:

a) injecting liquid fuel into all cylinders, b) producing an electrical input pulse by manually generated means, and c) routing said input pulse to the single cylinder in the power stroke position, said routing being achieved by causing said input pulse to enter the center terminal of said distributor through an intervening first diode.

2. Apparatus for starting an internal combustion engine having a multiplicity of cylinders equipped with a reciprocating piston and igniter adapted to fire when said piston is in its power stroke position, fuel supply means, a crankshaft driven by synchronized successive movements of said pistons, a timing system interactive with said crankshaft, an electrical system, and a distributor having a center input terminal that receives a continuous current through a feed wire from said electrical system, said distributor serving to produce an electrical output pulse and route said pulse to the igniter means of the single cylinder designated by said timing system to be momentarily in its power stroke position, said apparatus comprising:

a) manually activatable means for generating an electrical pulse, b) a manually activatable pump for liquid fuel, c) conveying means for transferring liquid fuel from said pump to the cylinders of said engine, d) an electrical conductor configured to carry said pulse to the center input terminal of said distributor, e) an intervening first diode associated with said electrical conductor and a second diode associated with said feed wire, said diodes having the same polarity with respect to said distributor and adapted to isolate said input pulse from the engine's electrical system.

3. The apparatus of claim 2 wherein said manually activatable means for generating an electrical pulse is a piezo crystal device.

4. The apparatus of claim 3 wherein, said manually activatable pump is comprised of a series of cylinders and interactive pistons, said cylinders each having a bottom and associated exit port through which fuel is expelled.

5. The apparatus of claim 4 wherein said pistons are downwardly driven by cams mounted upon an activating rod positioned above said cylinders, and said pistons are restored to an uppermost position by coil springs.

6. The apparatus of claim 5 wherein said pump is housed within a control box having opposing panel end extremities.

7. The apparatus of claim 6 wherein said activating rod penetrates and extends through said box in journaled engagement with said end extremities.

8. The apparatus of claim 7 wherein one extremity of said activating rod, disposed outside said box, is equipped with an operating lever, and a striking cam is disposed upon the opposite extremity of said rod, disposed outside said box and positioned to deliver a striking blow to said piezo crystal device.

* * * * *